United States Patent [19]

McGrath

[11] 4,239,582

[45] Dec. 16, 1980

[54] DATA FORM SPLICER

[76] Inventor: Thomas F. McGrath, R.R. #1, Box 259, Tinley Park, Ill. 60477

[21] Appl. No.: 134,779

[22] Filed: Mar. 28, 1980

[51] Int. Cl.[3] ..... G03D 15/04; B65H 21/00; B65H 69/06

[52] U.S. Cl. ..... 156/505; 156/157; 156/506; 156/522

[58] Field of Search ..... 156/157, 304.3, 502, 156/506, 505, 522

[56] References Cited

U.S. PATENT DOCUMENTS

| | | | |
|---|---|---|---|
| 2,506,933 | 5/1950 | Mercer | 156/505 |
| 2,827,104 | 3/1958 | Rives | 156/505 |
| 3,075,572 | 1/1963 | Catozzo | 156/505 |
| 3,318,754 | 5/1967 | Philippi | 156/505 |
| 3,428,511 | 2/1969 | Catozzo | 156/505 |
| 3,607,571 | 9/1971 | Tange | 156/505 |
| 3,607,572 | 9/1971 | Jorgensen | 156/505 |
| 3,622,425 | 11/1971 | Savarick | 156/505 |
| 3,664,903 | 5/1972 | McCorkle | 156/506 |
| 3,694,294 | 9/1972 | Cafiero | 156/505 |
| 4,056,426 | 11/1977 | Sipin | 156/505 |

*Primary Examiner*—Michael G. Wityshyn
*Attorney, Agent, or Firm*—McCaleb, Lucas & Brugman

[57] ABSTRACT

Apparatus for joining adjacent edges of sheet material, such as computer print-out data forms in which a splicing table having a planar work surface is formed with an elongated recessed groove for receiving a strip of pressure sensitive splicing tape; the tape being manually advanced along the groove to a desired length as determined by the width of the data sheet materials being joined. A plurality of spaced, male locating pins, fit into spaced openings in margins of the data forms to align the latter so that adjacent edges thereof are located centrally over the groove and tape, in position to be pressed downwardly onto the underlying adhesive tape which interjoins the same. Suitable cutter means are provided for severing the tape and releasing the spliced data sheets from the apparatus, with removal of the spliced forms automatically pulling the splicing tape from the recessed groove and detaching the data sheets from the guide pins.

4 Claims, 4 Drawing Figures

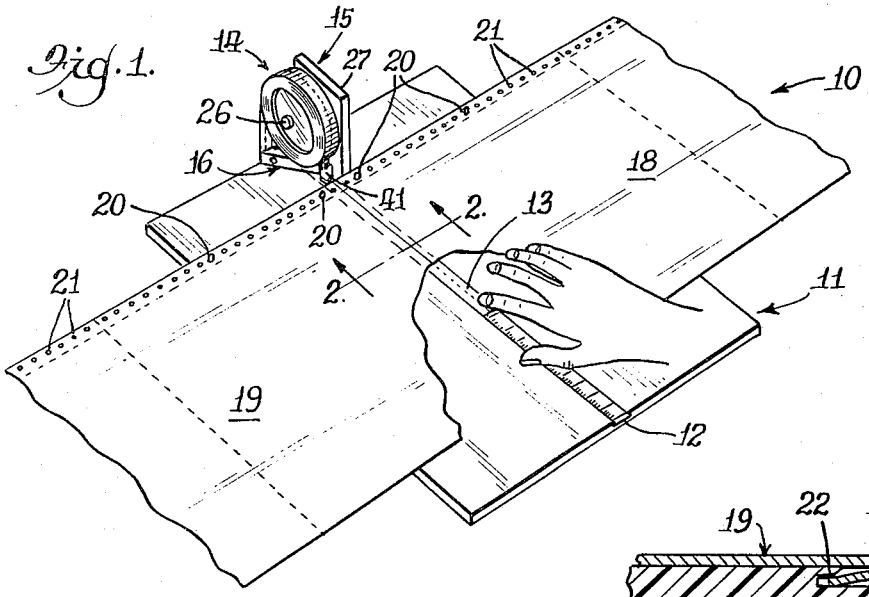
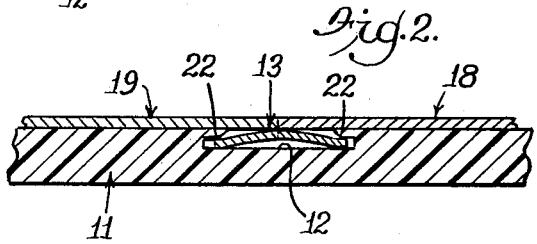
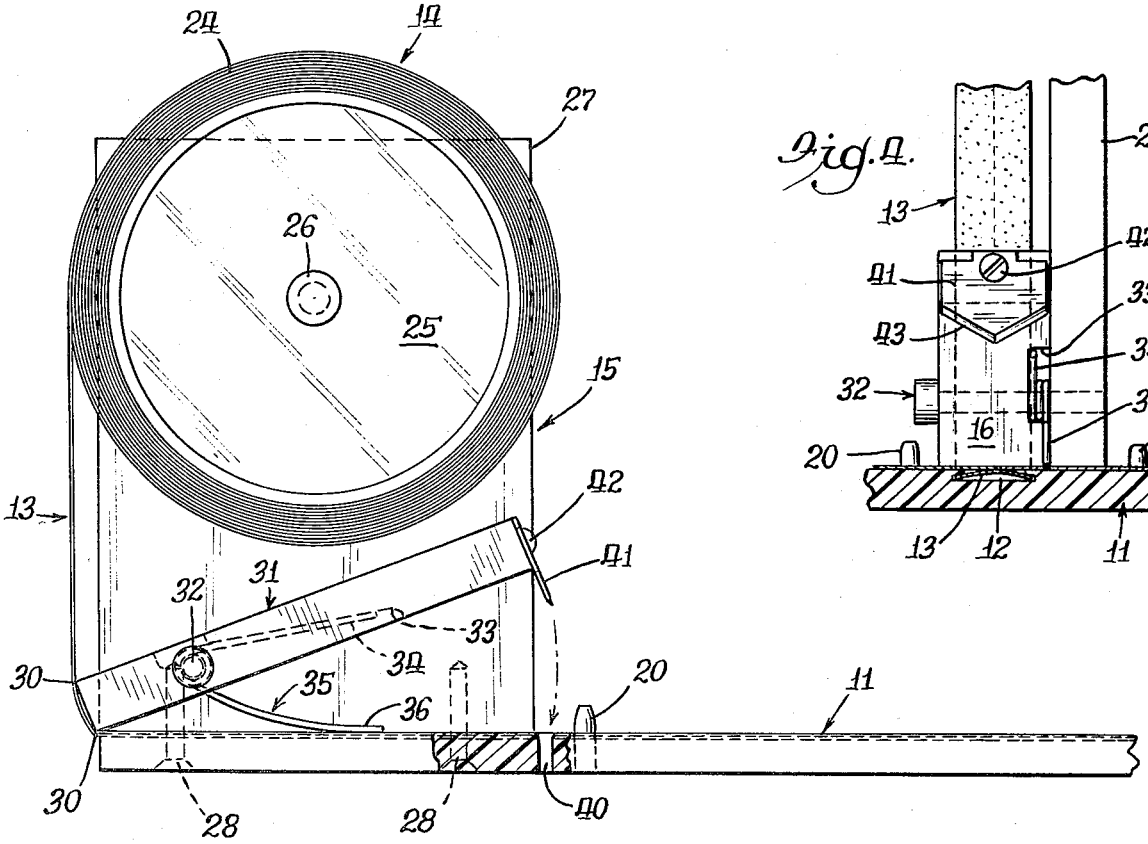
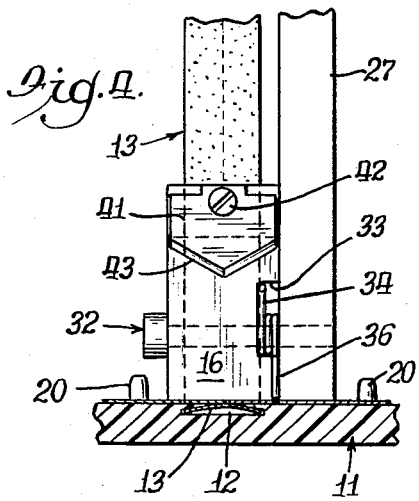
Fig. 3.

DATA FORM SPLICER

BACKGROUND OF THE INVENTION

In the art of data processing it is familiar practice to employ so-called continuous run, data process forms made up of a plurality of folded data print-out sheets which are normally joined along adjacent edges by perforations so that after a particular data run the print-out sheets may be separated from a supply stack thereof. Often it is necessary during the course of a prolonged, continous print-out to splice adjacent stacks of the data forms to avoid disruption of the print-out cycle. Under current practice this splicing is usually accomplished manually by applying adhesive celephane tape between edges of adjacent forms to be joined. If the form sheets are not accurately aligned and adhered when they are so interjoined, difficulty may be encountered in feeding the data forms through the processing equipment. Further, in order to interjoin adjacent data sheets, under the above described procedure, it is necessary to maintain alignment of the sheet edges while smoothly applying the adhesive tape which may require at least two people, one to hold the data sheets while the other applies the splicing tape.

SUMMARY OF THE INVENTION

This invention relates to splicing apparatus and more particularly to improved means for joining adjacent sheet materials, such as data forms used in continuous data processing employed in the computer arts.

In brief, the present invention comprises a splicing table having a planar work surface formed with an elongated groove recessed inwardly of the work surface for receiving a length of splicing tape having pressure sensitive adhesive over an upwardly disposed face thereof. The tape is supplied to the groove from a suitable supply roll from which the tape is manually fed. Suitable cut-off means are employed for severing the tape from the supply roll and tensioning means are provided for maintaining the splicing tape in a smooth and unwrinkled condition within the recessed groove. A plurality of spaced male locating pins project upwardly from the work face of the table; the same lying along an axis aligned at right angles to the longitudinal axis of the tape groove. Such pins are adapted to be inserted through appropriately spaced openings formed along marginal areas of the data forms to accurately locate and hold adjacent data forms on the work table so that the edges thereof to be joined are located centrally over the groove and splicing tape. Thus means are provided according to this invention for accurately aligning and holding adjacent data form sheets for interjoining their opposingly adjacent edges by manually pressing the edge margins downwardly on the adhesive surface of the underdisposed splicing tape. After severance of the tape by the cutting means, the spliced forms and tape are removed from the table, stripping the tape from the recessed groove in the process.

Prior art patents which are generally relevant to this invention include: U.S. Pat. Nos. 2,506,933, of May 9, 1950; 2,565,009, of Aug. 21, 1951; 3,075,572, of Jan. 29, 1963; 3,428,511, of Feb. 18, 1969; and 3,694,294, of Sept. 26, 1972. It is to be noted however, that none of the above listed patents address the problem confronted by the present invention or provide a useful solution for such problem; the same being largely concerned with the splicing of movie film or magnetic tape.

It is a principal object of this invention to provide improved apparatus for use in joining sheet materials along adjacent edges.

An additional object of this invention is to provide improved apparatus, as aforesaid, in which splicing tape, provided with pressure sensitive adhesive on one face thereof, is located and positioned for adherence to the underside of a pair of adjacently aligned data process forms, whereby the latter may be joined together.

Still another object of this invention is to provide an improved splicing apparatus for joining adjacent data processing forms including means for accurately locating and holding adhesive splicing tape, means for accurately locating and aligning adjacent data processing forms in splicing position over said tape, means for severing the splicing tape at completion of the splicing operation and means for tensioning the splicing tape while the same is fed to its location for adherence to the adjacent data forms.

A still further object of this invention is to provide improved splicing apparatus for joining continuous print-out data forms of the type used in the processing of computer intellegence, which apparatus exhibits improved economies of production and simplicity of operation.

Having described this invention, the above and further objects features and advantages thereof will be recognized to those of skill in this art from the following description of a preferred embodiment thereof, illustrated in the accompanying drawings and representing the best mode presently contemplated for carrying out its teachings and concepts.

IN THE DRAWINGS

FIG. 1 is a perspective illustration of a data form splicer according to this invention, in operational relation with a pair of data forms to be spliced thereby;

FIG. 2 is an enlarged cross-sectional view taken substantially along vantage line 2—2 of FIG. 1 and looking in the direction of the arrows thereon;

FIG. 3 is an enlarged side elevational view of the tape supply and tape tensioning and cut-off means employed in the apparatus of FIG. 1; and FIG. 4 is an end elevational view, of the means illustrated in FIG. 3.

DESCRIPTION OF THE PREFERRED EMBODIMENT

With initial reference to FIG 1, there is illustrated apparatus according to this invention, indicated generally by numeral 10, comprising a rectangular splicing table or stage 11 having an upper planar work or splicing surface formed with an inwardly recessed groove or slotted opening 12, receptive of a length of splicing tape 13 provided from a supply means 14 supported directly over one end of the slotted opening 12 on support means 15. Disposed between the supply means 14 and the staging table 11 and directly over the slotted opening 12 are cut-off means 16 used for severing and tensioning the splicing tape 13 as will appear in greater detail from the operational description which follows.

As shown, splicing table 11 is adapted to receive adjacent rectangular shaped paper data forms 18 and 19 over the upper work surface thereof; such forms being accurately located so as to align adjacent edges to be joined in near abutting relationship (see FIG. 2). Spaced male locating pins 20, 20 project upwardly from the table's work surface and are aligned along an axis at right angles to the longitudinal axis of the slotted opening 12. Pins 20 are adapted to be received in openings 21 formed along margins of the data forms for purposes of accurately locating the data forms in position for the splicing operation.

As best shown in FIG. 2 of the drawings, staging table 11 is of sufficient cross-sectional thickness to accomodate the formation of the elongated groove or slot 12 therein which preferably is generally dove-tail shaped in cross-section as shown, modified slightly to provide a pair of overhanging lip portions 22, 22 having radiused corners extending along the longitudinal or lateral margins of slot 12; the same being symetrically spaced relative to the longitudinal axis of the groove. While herein shown as integral with the table 11, the overhanging lip portions 22, 22 may be formed as separate strip elements, glued or otherwise secured in place to provide the desired overhanging margins for groove 12. The bottom face of the groove 12 is planar and preferrably inscribed with scale measuring means 23 (see FIG. 1) having suitable graduation markings. The measuring means is used to measure the needed length of the tape fed from the supply roll 14 according to the width of the data forms 18 and 19 to be joined.

As shown in FIG. 2, tape 13 is placed over the bottom of longitudinal groove 12 with its lateral margins or edges disposed beneath the overhanging lip portions 22 whereby to maintain the tape in a generally coplanar condition within the rectangular cross-sectional bottom portion of the groove, although there may be a slight bowing or semi-curvilinear positioning of the tape 13, as illustrated. It is to be understood that the dimensions of the groove 12 are such as to permit the tape normally to move relatively freely along the groove beneath the overhanging lip portions 22, 22. In this regard it will be noted from FIG. 1 that it is intended for a measured length of the tape 13 to be advanced manually along the groove in accordance with the indicia of scale 23, by engaging the adhesive coated upper face of the tape with the operator's index finger and pulling the same to a desired position along groove 12.

As further shown in FIG. 2, the two data forms 18 and 19 to be interjoined or spliced by means of tape 13 are located so their adjacent edges (unnumbered) abutt substantially centrally over the longitudinal axis of the tape. In this regard, it is preferable that the tape 13 be formed with a perforation line generally centrally along its longitudinal axis so that once the data forms, such as forms 18 and 19, are interjoined thereby the same may be separated at will by severing the tape along its perforation axis in accordance with recognized practice. Whether or not the tape is perforated is optional in accordance with the desires of the operator and user and is of no particular consequence to the merits of the present invention.

Turning now to FIGS. 3 and 4 of the drawings the detailed aspects of the tape supply means 14 and the cut-off means 16 will now be described.

As shown in FIG. 3, a cylindrical reel of tape 24 is mounted on the periphery of a cylindrical supporting hub or drum 25 which is rotatably supported on support means 15, by an axle 26 extending outwardly from one face of an upright support block 27 extending from the upper face of the staging table 11. Block 27 is secured to table 11 as by machine screws 28, although other fastening means may be employed to bring about a rigid structural relationship between the table and the support means 15. In the particular illustrated embodiment the drum 25, the support block 27 and the staging table 11, are all of clear plastic as shown, although other rigid materials such as metal may be employed with equal facility for the purposes of the indicated members.

It will be recognized that the supporting drum 25 for the reel of tape 24 is disposed so as to align the tape directly over the slotted opening 12 formed across the staging table, whereby the tape may be threaded beneath the overhanging portions 22, 22 in operation. It will be seen for example from FIG. 3, that the splicing tape, which as previously noted is coated on one side with pressure sensitive adhesive, is trained downwardly from reel 24 into the outer end of the slotted opening 12, entering such slotted opening at the left hand end of the structure illustrated in FIG. 2. Prior to its entry into one end of the groove 12, the tape passes over the outer radiused end corners 30, 30 of a pivotally supported brake arm 31 which serves as the operating member for cut-off means 16; arm 31 being rotatably supported on axle means 32 extending outwardly of one face of the upright support block 27.

A cut-away recess 33 is provided on one face or the brake arm, adjacent the axle 32 to receive one upper leg 34 of a coil spring means 35 having one or more turns disposed about the support axle 32 and a lower leg 36 thereof engaged with the upper face of the staging table 11. In this fashion the arm 31 is normally spring biased in a counterclockwise direction as viewed in FIG. 3, causing the outer rounded edges 30 thereof to engage the tape 13 and tension the same as it is pulled along the slotted groove 12 in the staging table. Such engagement between the arm and the tape 13 also assists in training the tape into and maintaining the same beneath the overhanging lip portions 22, 22 of the groove 12.

The tape 13 is trained along the slotted groove 12 and passes over an opening 40 formed through the staging table 11 directly in the movement path of a cut-off knife 41 mounted at the outer end of the brake arm 31 (see FIGS. 3 and 4). As best shown in FIG. 4, the knife means 41 is generally rectangular in shape and is affixed to the outer end of arm 31 by screw means 42; the lower end of the knife blade preferably being formed in a V-shaped or chisel point having sharpened edges 43, 43 for purposes of vertically penetrating and severing the tape 13 without pushing the same laterally across the bottom of the groove 12. This cut-off operation is brought about quite simply by depressing the outer end of arm 31 downwardly to move the knife edges 43 through opening 40 in the underdisposed staging table 11, passing through and cutting the tape 13 in the process.

Use and Operation

Having described the various elements and their combination in accordance with the current invention, the operation, functioning and utilization of apparatus 10 will now be set forth.

When it is desired to interjoin or splice a pair of data forms, such as the two forms 18 and 19 illustrated in FIG. 1, the operator advances tape 13 along the slot 12 by means of his index finger until it has reached a desired position along scale 23, determined by the width of the forms 18 and 19. Thereafter, the two forms 18 and 19 are positioned on the staging table 11 and located in desired positions by placing the projecting guide pins 20, 20 through appropriate locating openings 21 in the margins of the forms, as previously noted. The adjacent or opposing edges of the forms, as shown in FIG. 2, are thus placed in near abutting engagement centrally over the longitudinal axis of the tape 13 located in the underlying groove or slotted opening 12, with the adhesive side thereof facing upwardly. The operator next runs the tip of his finger over the upper surfaces of the two forms directly above the slotted opening 12, pressing the lower surfaces of the forms onto the adhesive face of the underlying tape 13 and thereby adhering the latter to the tape. The tape is then cut from the supply reel by lowering the knife means 16 downwardly causing blade 41 to pass into opening 40 in the underlying table and cutting through the tape 13 in the process. Spring means 35 serves to return the cutter means 16 to its raised position as illustrated in FIGS. 1 and 2. The spliced data forms are then lifted from the staging table, extracting the tape from the groove 12 as the data forms come off the locating pins 20. Light finger pressure along the splice junction serves to adhere the edges of the tape 13 to the underface of the data forms. The splicing process is thus complete and the apparatus is readied for the next splicing operation by merely advancing the tape 13 an appropriate distance along the groove or slot 12, as above described.

Having described the present invention and its preferred embodiment illustrative of its concepts and utilization, it is believed that those familiar with the art will readily recognize and appreciate its advance over previous splicing devices of the prior art; it being understood that while the invention has hereinabove been described in association with a particular embodiment illustrated in the drawings, the same is susceptible to variations and modifications without departing from its inventive scope which is intended to be unlimited by the foregoing except as may appear in the following appended claims.

The embodiments of the invention in which an exclusive property or privilege is claimed are defined as follows:

1. Apparatus for splicing computer print out data forms and the like having a plurality of spaced openings punched along a margin thereof comprising: a planar staging table having an upper work surface formed with an elongated groove recessed inwardly of and extending across said work surface; said groove having a planar bottom and marginal portions overhanging lateral margins of said bottom for holding a length of splicing tape having adhesive coating over one surface in said groove with its adhesive coating facing upwardly; tape supply means located over one end of said slotted groove whereby said tape may be manually fed into one end of said groove; means adjacent said supply means for severing said tape, spaced locating means extending upwardly from said work surface for engaging spaced openings in said data form margins to locate the same on said work surface such that adjacently opposed edges thereof are disposed centrally over the longitudinal axis of said groove whereby a length of tape located in the bottom of said groove may be adhered to the data form portions located thereover by pressing such form portions downwardly onto said tape's adhesive surface.

2. The apparatus of claim 1, wherein said severing means comprises pivotally mounted knife means movable through said groove during the tape severing operation thereof.

3. The combination of claim 1, and tape tensioning means comprising one end of a pivotally mounted arm, and spring means operable to bias said one end into tensioning contact with said tape as the latter is fed along said groove.

4. The combination of claim 1, wherein said groove is formed with a generally dove-tail cross-sectional configuration.

* * * * *